United States Patent [19]

Kenworthy

[11] 4,175,687

[45] Nov. 27, 1979

[54] UNIFORM INDEXING OF PAPER FORMS

[75] Inventor: Grant F. Kenworthy, Des Plaines, Ill.

[73] Assignee: Weber Marking Systems, Inc., Arlington Heights, Ill.

[21] Appl. No.: 864,336

[22] Filed: Dec. 27, 1977

[51] Int. Cl.[2] ..... G03B 1/30

[52] U.S. Cl. ..... 226/74; 226/121; 226/143; 226/188; 400/616.1; 400/551; 185/40 R

[58] Field of Search ..... 226/74, 75, 76, 24, 226/49, 108, 115, 121, 143; 400/616.1, 616.2, 551; 185/40 R

[56] References Cited

U.S. PATENT DOCUMENTS

| | | | |
|---|---|---|---|
| 3,371,834 | 3/1968 | Willits et al. | 226/115 |
| 3,381,867 | 5/1968 | Konkel | 226/115 |
| 3,856,128 | 12/1974 | Taggart | 226/32 |

*Primary Examiner*—H. Grant Skaggs

*Attorney, Agent, or Firm*—Kenneth T. Snow

[57] ABSTRACT

The accurate and uniform indexing of paper business forms with line hole punched margins. The index drive overcomes any possible accumulation of errors. A pawl and ratchet device is employed in the feeding of the paper form. The ratchet is rotated approximately one-half tooth beyond the ultimate desired stop. A spring urged arm then pulls the ratchet wheel back that one-half tooth turn so the pawl rests solidly in a single ratchet tooth. It is this same spring arm that pulls back the over-fed paper form. The form pull back is permitted by reason of a magnetic one-way clutch being momentarily released at the end of the mechanical feed-out. The present device is a combination of a mechanical drive with a magnetically releasable clutch to effect a constantly accurate feed out of paper forms resulting in identical positioning of each of the series of continuous paper forms.

3 Claims, 6 Drawing Figures

UNIFORM INDEXING OF PAPER FORMS

BACKGROUND OF THE INVENTION

1. Field of the Invention

Paper forms usually of the plural and carbon interleaved type, such as invoice forms, are pre-made in a continuous strip with punched margins and fanfolded along transversely extending perforations by a manufacturer. The ultimate users of these forms feed them through their stencil tabbing machines such as shown in my copending patent applications entitled STENCIL TABBING MACHINE, Ser. No. 857,680 filed Dec. 5, 1977 and now Pat. No. 4,154,640 and entitled APPLICATOR FOR LIQUID ADHESIVE TO A PAPER FORM FOR SECURING A STENCIL THERETO, Ser. No. 857,686 filed Dec. 5, 1977 or their imprinting typewriters or the like by engagement with the regular spaced punches in the margins. The forms are usually addressed and other data concerning a sale of goods, for example, are inserted. The automatic feeding or indexing of these fanfolded forms thus controls the positioning of the typed matter to be inserted on the forms. Most of the feeding means employed on existing machines is accomplished by a reciprocating crank arm that drives a single direction clutch. This type of indexing is inexpensive and is commonly used where exactly repetitive indexing is not required. The major objection to this type of feed or indexing is that any error in the setting or initial adjustment of the crank arm stroke is cumulative. In other words the errors in feed out add up so that what may have been an insignificant error on the first feed out may seriously impair the positioning of the typed matter at some point down the line. Even a discrepancy which is so small as to be not noticeable will accumulate and cause a mismatch in relation to a required indexed point on an accurately printed business form. The present device overcomes this condition of error accumulation by slightly overfeeding the forms and then when the feed drive is momentarily declutched the forms are pulled back to a fixed index point. This assures that the forms will always be in the same relative position after each indexing.

2. Description of the Prior Art

A patent search was conducted and the following United States patents were believed to be pertinent to the patentability of the device of this invention.

Ramsey—U.S. Pat. No. 1,388,892
Metzner—U.S. Pat. No. 2,881,893
Drillick—U.S. Pat. No. 3,292,832
Murayama et al—U.S. Pat. No. 3,610,495
Taggert—U.S. Pat. No. 3,856,128
Buxton—U.S. Pat. No. 3,987,884

The Ramsey patent shows a device to move or advance film in a motion picture camera or projector. The inventive feature related to a combined pushing and pulling of the film being moved.

Metzner discloses a typewriter with means to alternately friction feed paper or pin feed margin punched paper.

Drillick provides for movement of a hole punched paper stock both forwardly or rearwardly. Two oppositely arranged pawls are employed. When one pawl is engaged the other is automatically disengaged and vice versa.

Murayama et al shows a device to feed a paper tape or card by an escapement device (pawl and ratchet). An electrical magnet is used to control or stop the operation.

Taggart shows a tractor drive for a margin punched paper web. A counter is employed to advance the stock commensurate with the number of lines set on the counter.

Buxton discloses a tractor drive for margin punched paper web. Here the device is a print-out mechanism and the tractor is capable of driving both forward and reverse and also shifting laterally for intermediate printing.

Although all of the above described patents show means for moving margin punched webs or the like and some employ pawls and ratchets to advance the webs, none of them show or suggest the construction of the present invention. Applicant combines a mechanical feed drive with a magnetically releasable clutch and a spring motor to effect an accurate and repeatedly uniform indexing of paper forms.

SUMMARY OF THE INVENTION

A principal object of the present invention is to provide a novel indexing means for a web of paper forms of the type having punched margins.

An important object of this invention is to provide a novel continuous web indexing means incorporating an error eliminator.

Another important object of this invention is to provide a novel mechanical forward feed for margin punched paper forms with a magnetically releasable clutch at the end of the stroke at which time the forms are mechanically pulled rearwardly into exact register with an index point.

A still further important object of this invention is to provide a novel pawl and ratchet feed for margin punched paper forms having means therein for avoiding the accumulation of errors in the feed out.

Another and still further important object of this invention is to provide a novel indexing means for margin punched paper forms which is error free in its operation and repeatedly stops fanfolded continuous paper forms in the identical spot each indexing operation for proper relationship with the accurately printed forms.

Other and further important objects and advantages will become apparent from the disclosures in the following specification and accompanying drawings.

IN THE DRAWINGS

Figure 1:
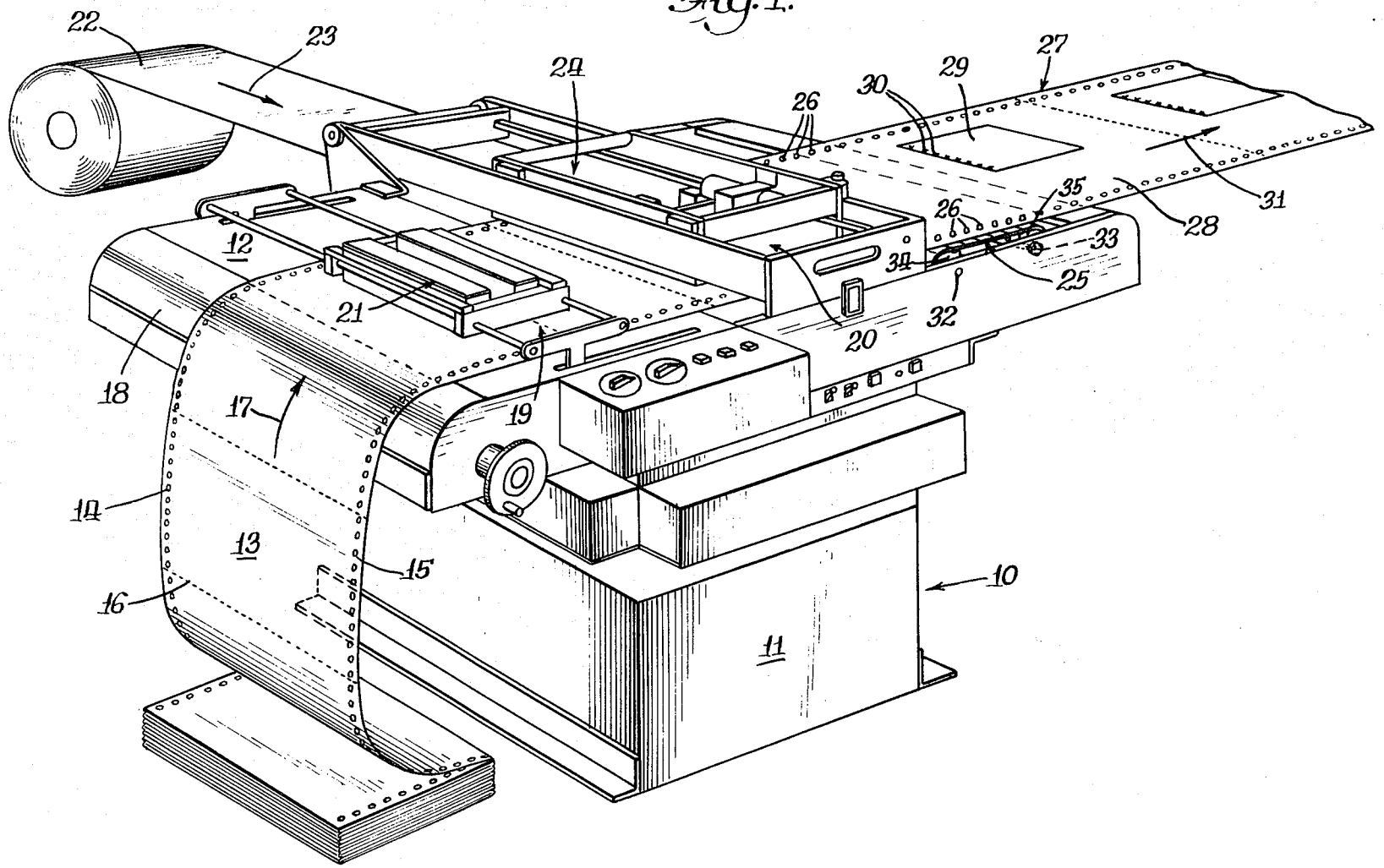
FIG. 1 is a perspective view of a stencil tabbing machine incorporating the forms driving mechanism of this invention.

AS SHOWN IN THE DRAWINGS the reference numeral 10 indicates generally a frame for a stencil tabbing machine incorporating the forms indexing device of this invention. The machine frame comprises a base 11 and a table portion 12. In use, the machine takes a stack of plural leaved paper business forms in a continuous series, identified by the numeral 13, and tabs a stencil to each of the defined business forms. As a rule the previously made business forms are provided in fanfolded stacks and it is from a stack such as this that the forms 13 are fed into the machine. The forms 13 are equipped with regularly spaced apart holes along each side margin as shown at 14 and 15. It is by these margin holes that the forms are fed by engagement with the drive mechanism of this invention. The forms 13 are further equipped with transverse perforations 16 to define individual forms. The arrow 17 shows the direction of entry of the forms into the machine. The forward end of the table is provided with a curved sheet 18 to guide the entrance of the business forms 13 in a smooth arc onto the table 12 of the machine. A first area is designated as station 19 and then a second longitudinally spaced apart area is designated as station 20. It is on the table 12 that the business forms are adapted to receive an application of adhesive at the first station 19 and the tabbing of a stencil onto that adhesive at the second station 20.

A liquid adhesive applicator means 21 is positioned over the table 12 at the location of the first station 19.

A continuous strip supply of stencils 22 are delivered to the machine from the far side thereof in the direction of the arrow 23. These stencils 22 come into the machine at the location of the second station 20. A stencil cut-off and placement mechanism 24 acts to cut, convey and deposit a severed stencil 22 onto the liquid adhesive previously applied on the plural leaved business forms at the first station 19.

Form drive tractors 25 constituting the present invention, are located at the far end of the machine beyond the second station 20 and act to pull the continuous strip of business forms 13 through the machine. The drive tractors have radial pins 26 engaging the margin holes 14 and 15 of the business forms 13 and cause the forms to be advanced a uniform distance in an indexing manner.

The stencil tabbed business forms exiting from the far end of the machine are designated by the numeral 27. The tabbed forms include a plural leaved paper business form 28, a stencil 29 on the form, and a line of adhesive 30 indicating the attachment of the stencil to the form. An arrow 31 shows the direction of exit of the stencil tabbed forms 27 from the stencil tabbing machine.

Figure 3:
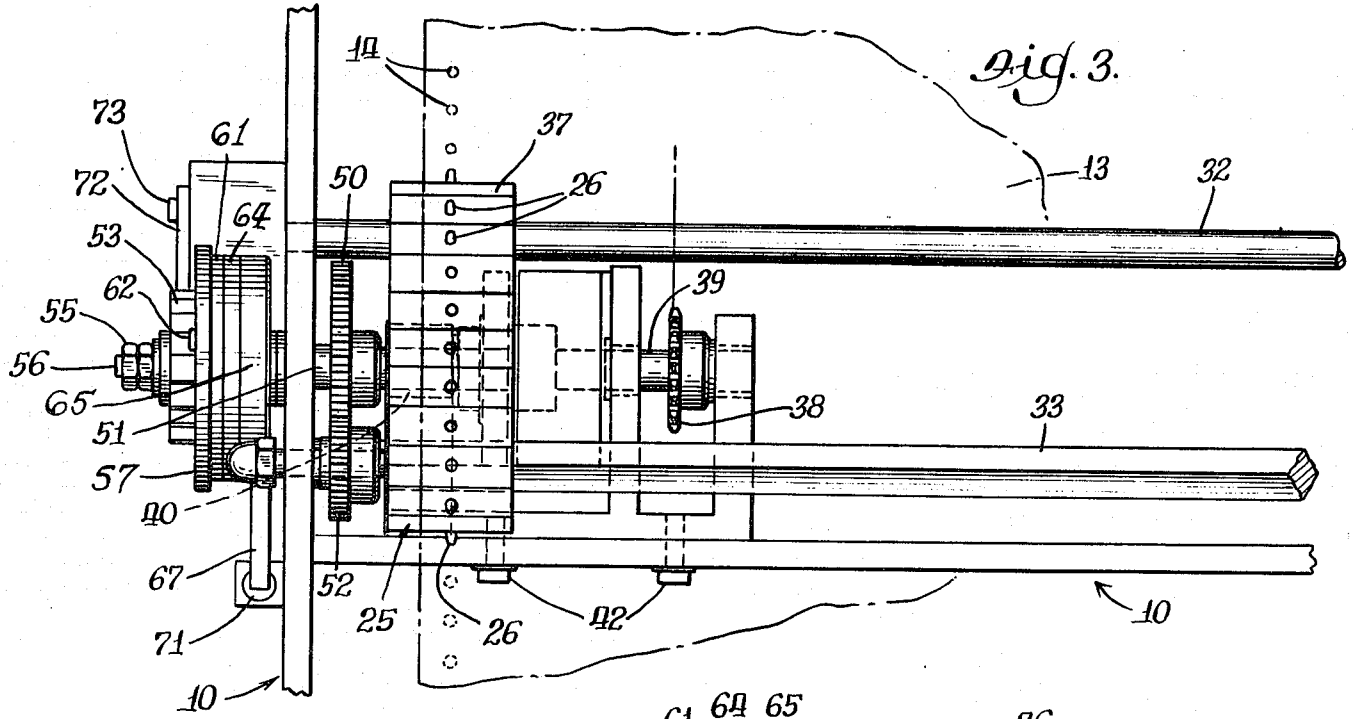
FIG. 3 is a top plan view of the forms driving mechanism of this invention and as shown in FIG. 1.

The drive tractors 25 comprise the following elements. A transversely disposed shaft 32 is fixedly carried in the frame 10. FIG. 3 shows the mounting of just one end of this shaft and the other end broken away. It should be understood the other end would be similarly mounted in another portion of the frame 10. A generally parallel shaft 33, square in cross section, is journally carried in the frame 10 and is termed the tractor drive shaft. A sprocket 34 is journally mounted on the fixed shaft 32. A sprocket 35 in the same plane as the sprocket 34 is mounted on and is driven by the square tractor drive shaft 33. A chain 36 engages and joins the sprockets 34 and 35. The chain is provided with relatively wide link members 37 to provide a broad surface on which the paper forms 13 are supported.

As shown in FIG. 3, a portion of a paper form 13 is indicated by dashed lines and is disposed on the relatively wide link members 37. The outwardly projecting pins 26 of the drive tractor 25 pass upwardly through the punched holes 14 in the margin of the paper forms. The drive tractor is thus capable of engaging the paper forms through the margin holes 14 and effect a movement or indexing of the forms by a pulling action thereon. The form drive tractors 25 are capable of acting on any width of paper forms by reason of the adjustability of the tractor 25 along the length of the transversely disposed carrying shafts 32 and 33. Further, one or two such drive tractors may be employed to effect the feeding of the paper forms. It is usual to have two such tractors on the shafts 32 and 33 with a spacing such that the outwardly or radially disposed pins 26 engage the margin holes 14 and 15 simultaneously and thus provide a uniform even feeding of the paper forms through a machine utilizing these forms.

Figure 4:
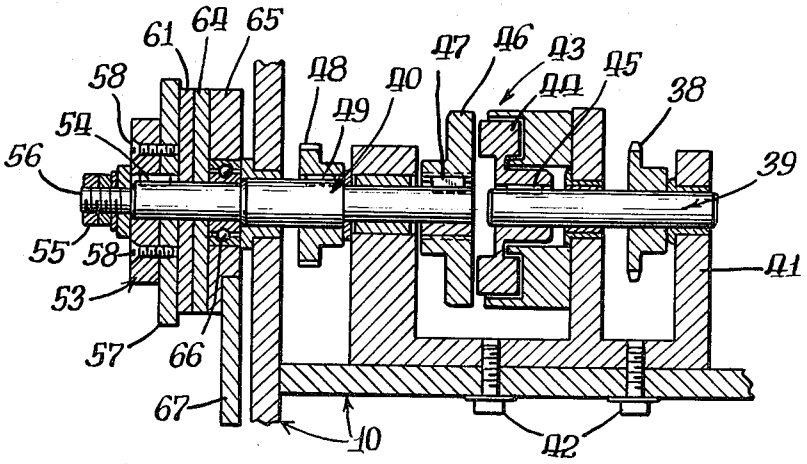
FIG. 4 is a sectional view taken on the line 4—4 of FIG. 2.

A sprocket 38 is driven by a power source (not shown) from within the stencil tabber. This driven sprocket 38 is utilized to effect operation of the indexing mechanism of this invention. The driven sprocket 38 is carried on and affixed to a drive shaft 39 such that as the driven sprocket is rotated the drive shaft 39 will be similarly rotated. As best shown in FIG. 4 an axially aligned but spaced apart driven shaft 40 is provided. A sub-frame 41 is attached by means of bolts 42 to the main frame 10. The sub-frame 41 is arranged and constructed to journally carry the drive shaft 39 and the driven shaft 40.

As further shown in FIG. 4 there is provided a one-way magnetic clutch 43 having a clutch rotor driving member 44 fastened by means of a key 45 to the drive shaft 39, and a clutch armature driven member 46 being fastened by means of a key 47 to the driven shaft 40. Thus the one-way magnetic clutch is mounted on both the drive shaft and the driven shaft and is the means for transmitting driving rotation from the drive shaft to the driven shaft. When the clutch elements 44 and 46 are magnetically engaged there is drive imparted from the drive shaft 39 to the driven shaft 40.

Figure 2:
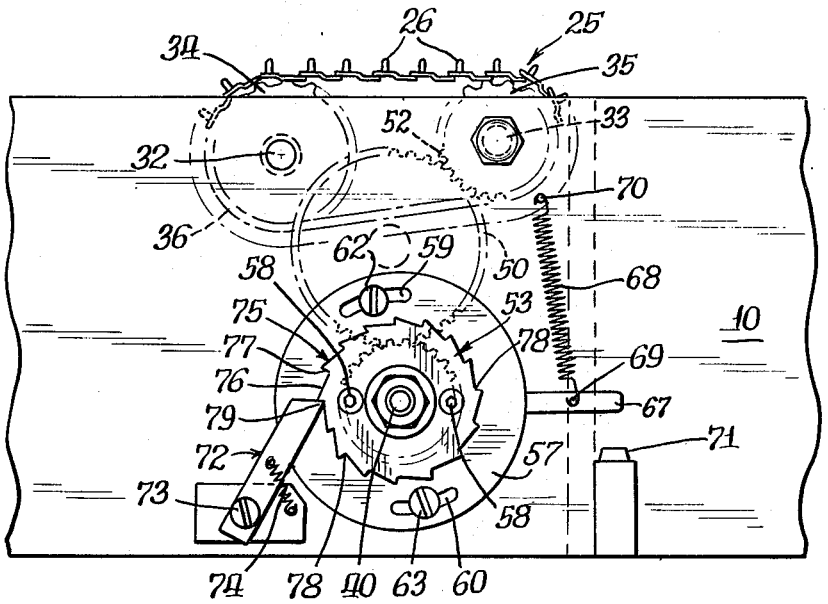
FIG. 2 is an end view of the forms driving mechanism of this invention.

The driven shaft 40 is provided with a gear 48 being fastened thereto by means of a key 49. Thus as the driven shaft 40 is rotated the drive gear 48 is also rotated. It is this drive gear 48 that is utilized to impart rotation to the tractor drive shaft 33. As best shown in FIGS. 2 and 3 a relatively large diameter idler gear 50 is journally mounted on a stub shaft 51 which in turn is affixed in and carried in the frame 10. A driven gear 52 is affixed to the tractor drive shaft 33. The drive gear 48, the idler gear 50, and the driven gear 52 all lie in the same plane. The drive gear 48 meshes with the idler gear 50 and the idler gear 50 meshes with the driven gear 52. It is this arrangement and meshing of gears that transmits rotation from the driven shaft 40 upwardly to the tractor drive shaft 33.

Figure 5:
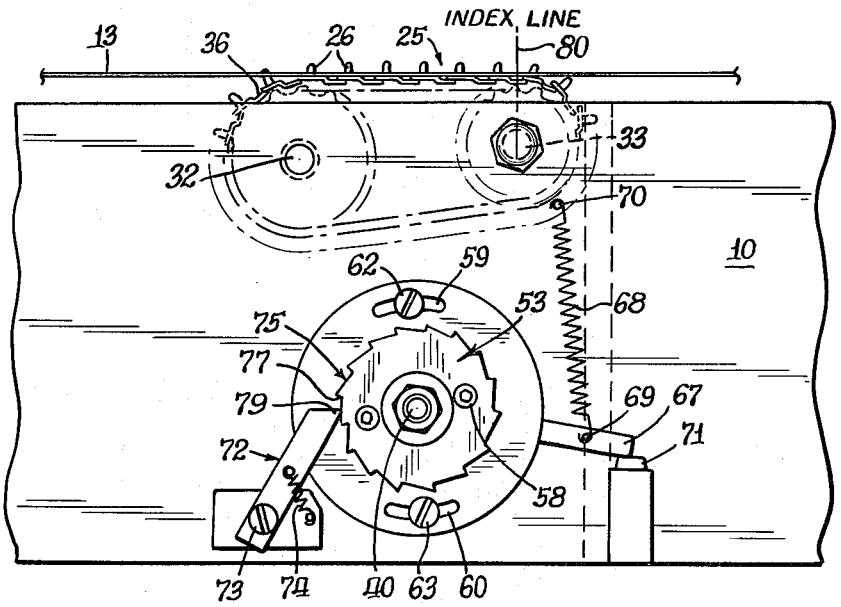
FIG. 5 is an end view of the device as shown in FIG. 2 but with the ratchet indexing means moved its maximum position.
Figure 6:
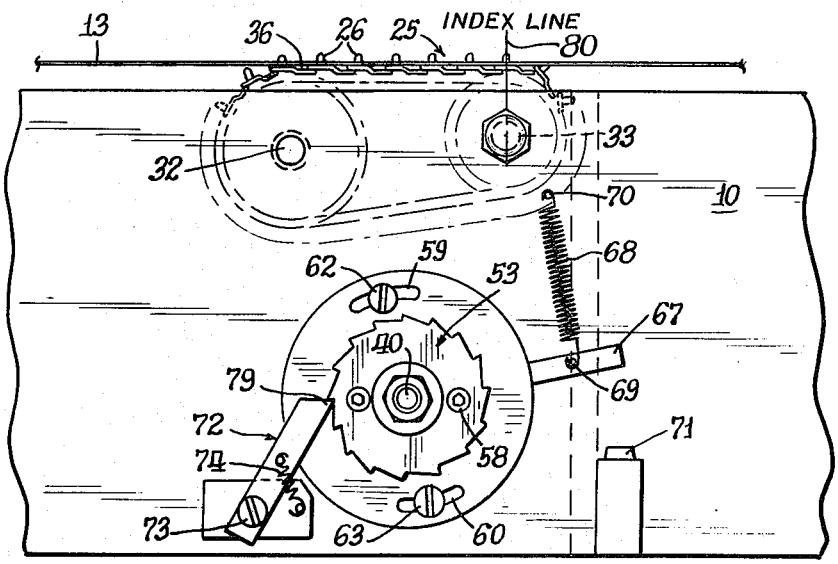
FIG. 6 is an end view of the device as shown in FIGS. 2 and 5 but with the ratchet indexing means moved back to its index stop point.

A ratchet wheel 53 is joined by means of a key 54 to the driven shaft 40. Lock nuts 55 engage a threaded end 56 of the shaft 40. With this construction it will be seen that simultaneous rotation is imparted from the driven shaft 40 to both the drive gear 48 and the ratchet wheel 53. A large diameter ratchet drive plate 57 is provided adjacent the ratchet wheel 53. Screws 58 are utilized to attach the ratchet wheel 53 to the large diameter drive plate 57. As best shown in FIGS. 2, 5 and 6, diametrically disposed elongated arcuate slots 59 and 60 are provided in the drive plate 57 near the outer circumference thereof. An adjustment plate 61 is journally carried on the driven shaft 40 and is disposed adjacent the ratchet wheel 53 and its large diameter ratchet drive plate 57. A set screw 62 passes through the arcuate slot 59 and threadedly engages the adjustment plate 61.

Similarly a set screw 63 passes through the arcuate slot 60 and threadedly engages the adjustment plate 61. It will be apparent from this construction that the length of the elongated slots 59 and 60 provide the means for arcuately adjusting the ratchet wheel 53 relative to the adjustment plate 61.

A friction disc 64 is journalled on the shaft 40 and lies in abutting relationship with the adjustment plate 61 on one side thereof and on its other side the friction disc engages a reversing plate 65. The reversing plate 65 is carried on a ball bearing 66 mounted on the shaft 40. Thus the reversing plate 65 is not driven by the driven shaft 40 but rather may have separate rotation relative to the driven shaft 40. The reversing plate 65 is provided with a generally radially outwardly extending arm 67 so that in the event the reversing plate is rotated in either direction the arm 67 will move therewith. A spring 68 has one end attached at 69 to the arm 67. The other end of the spring 68 is fixed to a post 70 on the frame 10. A stop 71 is supported on the frame 10 and is arranged and constructed to limit the degree of rotation of the reversing plate 65. This assembly of elements constitutes a spring motor.

A pawl 72 is hingedly mounted at 73 on the frame 10. A pawl return spring 74 is adapted to spring bias the pawl toward engagement with the ratchet wheel 53. The ratchet wheel 53 is provided with teeth 75, each of which has a low angled elongated side 76 and a short radially disposed side 77. Each of the teeth 75 is provided with a root 78 at the inner juncture of the side 76 and the side 77. The pawl 72 is provided with a generally tapered outer end 79 which engages the teeth 72 of the ratchet wheel 53.

In the operation of the tractor form feeding mechanism of this invention the sprocket 38 is rotatably driven a predetermined amount. When the driven sprocket is being rotated the magnetic clutch 43 is engaged so that drive is imparted from the clutch part 44 on the shaft 39 to the clutch part 46 on the driven shaft 40 thereby delivering rotational drive from the drive shaft 39 to the driven shaft 40. This in turn causes rotational drive of the gear 48 and by means of the intermediate idler gear 50 imparts drive to the driven gear 52 on the tractor drive shaft 33. Thus, the tractor 25 is actuated and the paper forms are advanced as the driven sprocket 38 is rotated. Simultaneously with the advancement of the paper forms 13 there is a rotation of the ratchet wheel 53 on the outer end of the driven shaft 40. The driven sprocket 38 is rotated slightly more than is required for the desired feed of the paper forms 13. This slightly greater movement of the paper forms than desired is shown by the position of the pawl 72 relative to the ratchet teeth 75 in FIG. 5 of the drawings. In that position, the tapered point 79 of the pawl 72 is shown engaging substantially centrally of the long low angled side 76 of one of the ratchet teeth 75. Thus, the amount of over-feed is substantially equal to one-half the length of a ratchet tooth 75. Rotation of the ratchet wheel assembly causes simultaneous rotation of the reversing plate 65 by reason of the ratchet wheel assembly rotation driving through the friction plate 64 to the reversing plate 65. Rotation of the plate 65 continues until the reversing arm 67 strikes the stop block 71 as shown in FIG. 5. At this point the return spring 68 has been stretched a substantial amount and constitutes the charging of this spring motor. After the arm 67 strikes the block 71 the friction disc 64 slips in its engagement with the indexing reversing plate 65. During continued attempted drive of the reversing plate 65 the reversing arm 67 is held against the stop block 71. When the drive to the sprocket 38 has completed its action and the pawl 72 is between the ratchet teeth as shown in FIG. 5 the magnet in the clutch rotor 44 is deenergized to halt the interconnection between the drive shaft 39 and the driven shaft 40. Immediately upon the deenergizing of the clutch 43 the charged spring motor is released to permit the reversing arm 67 to be pulled upwardly by the reversing spring 68 which rotates the reversing plate 65 in an opposite direction. The friction disc 64 acting as a clutch delivers this reverse direction rotation to the ratchet drive plate and its integral ratchet wheel 53 causing the tapered end 79 of the pawl 72 to back down into the root 78 exactly between two adjacent one-way ratchet teeth 75 as shown in FIG. 6 of the drawings. This reversing motion of the ratchet wheel 53 causes a simultaneous reversing movement of the driven shaft 40. The gears 48, 50 and 52 are also reversed and this causes the paper forms to be pulled back to a predetermined position. An index point 80 is designated on FIGS. 5 and 6 of the drawings. In this instance the index point 80 is a line coincident with a center line through the tractor drive shaft 33. FIG. 5 shows that the tractor 25 has moved a distance substantially equal to that of one-half tooth beyond its desired position with the pawl resting midway between one of the one-way ratchet teeth. In FIG. 6 the tractor drive 25 has been pulled back so that one of the form engaging fingers 26 lies directly on the index line 80 and the pawl lies between two adjacent one-way ratchet teeth.

It would appear this is a rather complicated drive mechanism to accomplish an indexing of a paper form in a machine using such paper forms. However, it is very important that paper business forms be located in exactly the same position on each indexed movement thereof. If this does not occur in the stencil tabbing machine, the stencil will be misplaced on the form, or if the forms are being moved through some other machine such as an imprinter or typewriter the imprinting would be placed in the wrong position on the paper forms. In most of the drive mechanisms of which applicant is aware there is no means of assuring repeated exact positioning of the indexed forms relative to the machine through which they are moving. A uniform incremental advance of paper forms without correction might be adequate for some time providing the initial error is extremely small. However, despite the smallness of such an initial error in the feedout length, the results could be disastrous as those errors accumulate until there is no correlation between the form and the relative positioning of the work to be performed on that form. Applicant has developed an error free system of indexing by slightly over-feeding the initial feedout of the paper forms, releasing the initial drive, and utilizing a spring motor, energized by the initial forward movement, to pull back the over-feed to just exactly the right point of stop for the business form. It is this utilization of a mechanical drive with a slight overfeed and a magnetically operable clutch in combination with a spring reversing motor to pull a paper form into a fixed position on each indexing of the forms that eliminates the cumulative effect of drive mechanism errors. With this construction the accurately printed forms will be fed accurately and uniformly.

I am aware that numerous details of construction may be varied throughout a wide range without departing from the principles disclosed herein and I therefore do not propose limiting the patent granted hereon otherwise than as necessitated by the appended claims.

What is claimed is:

1. An indexing mechanism for a continuous web having margin holes comprising a tractor engaging said margin holes, means actuating said tractor including a clutch driving element and a clutch driven element, gearing joining said clutch driven element to said tractor, a ratchet wheel joined to said clutch driven element, a pawl engaging said ratchet wheel, a spring motor, said spring motor having a friction disc engaging said ratchet wheel, said spring motor energized by rotation of said ratchet wheel when said clutch driven element is engaged with said clutch driving element, said spring motor acting through its said friction disc to reverse the direction of the tractor when the clutch driving and driven elements are disengaged, and means limiting the amount of reverse movement.

2. A device as set forth in claim 1 in which said means limiting the amount of reverse movement includes said ratchet wheel having a plurality of regularly spaced one-way teeth, said pawl spring biased into engagement with the one-way teeth of said ratchet wheel, said clutch driving and driven elements remaining engaged until said pawl rests substantially midway between a one-way tooth on the ratchet wheel, and said spring motor reversing the ratchet wheel rotation the distance necesssary to have the pawl engage the ratchet wheel exactly between two adjacent one-way ratchet teeth.

3. A device as set forth in claim 2 in which said ratchet wheel has means associated therewith for arcuately adjusting said ratchet wheel relative to the driven clutch element.

* * * * *